US008820196B1

(12) United States Patent
Kennedy

(10) Patent No.: US 8,820,196 B1
(45) Date of Patent: Sep. 2, 2014

(54) SAFETY BLOCK

(76) Inventor: Justin A. Kennedy, Dillsboro, IN (US)

( * ) Notice: Subject to any disclaimer, the term of this patent is extended or adjusted under 35 U.S.C. 154(b) by 232 days.

(21) Appl. No.: 13/589,215

(22) Filed: Aug. 20, 2012

Related U.S. Application Data

(60) Provisional application No. 61/524,983, filed on Aug. 18, 2011.

(51) Int. Cl.
*B25B 23/00* (2006.01)

(52) U.S. Cl.
USPC ..... 81/177.2; 81/177.85

(58) Field of Classification Search
USPC ..... 81/177.85, 180.1, 184, 177.2, 177.5
See application file for complete search history.

(56) References Cited

U.S. PATENT DOCUMENTS

| | | | | | |
|---|---|---|---|---|---|
| D105,337 | S | * | 7/1937 | McNaught | D8/17 |
| 3,039,339 | A | * | 6/1962 | Hanson | 81/177.2 |
| 3,376,768 | A | * | 4/1968 | Fortunato | 81/177.2 |
| 5,216,940 | A | * | 6/1993 | Hedden | 81/177.2 |
| 5,461,950 | A | | 10/1995 | Iwinski | |
| D368,007 | S | * | 3/1996 | Macor | D8/25 |
| 6,240,809 | B1 | | 6/2001 | Sasarak | |

* cited by examiner

*Primary Examiner* — David B Thomas
(74) *Attorney, Agent, or Firm* — Hasse & Nesbitt LLC; Daniel F. Nesbitt

(57) ABSTRACT

A safety block that includes a drive member on a lower face for attaching a socket or other tooling for applying torque to a screw, bolt, nut or other fastener. The safety block has a pair of drive pockets in an upper face of the block on opposed sides of a drive axis that passes through the drive member. The pair of drive pockets are sized and arranged to accept a square-shaped driver of a separately-provided wrench or breaker bar, to permit applying opposed, co-directional torque upon the socket or other tooling, thereby obviating the need to use a breaker bar or similar makeshift arrangement for breaking loose nuts and bolts in the field or on machinery.

16 Claims, 16 Drawing Sheets

SAFETY BLOCK

CROSS-REFERENCE TO RELATED APPLICATION

This application claims the benefit of U.S. Provisional Application No. 61/524,983, filed on Aug. 18, 2011, the disclosure of which is incorporated herein by reference.

BACKGROUND OF THE INVENTION

A cheater bar or cheater pipe is an improvised tool made from a length of pipe and a wrench, including a standard socket wrench. A cheater bar is sometimes called a pipe extension or an extension pipe. Cheater bars are usually used to free screws, bolts, nuts and other fasteners that are difficult to remove with a ratchet or wrench alone. Cheater bars are also commonly used to operate valves. When the handle of a wrench or ratchet is inserted into a cheater bar, the additional length of the pipe makes it possible to generate a required amount of torque to loosen the screw, bolt, nut or fastener with a reduced amount of applied force.

Notwithstanding the advantages of cheater bars, there are industrial and workplace problems with their use. For example, if the fastener is loosened and freed suddenly, the worker can be thrown off balance and become injured. More of a concern, the cheater bar itself can slip off and become a projectile against other persons or property in the vicinity, which could resulted in falls, impacts, punctures, and other injuries. Further, cheater bars are often arranged and used ad hoc, and are usually improperly sized and weighted for the need.

As a result of such problems and risks to workers and property, federal regulations provides that the tools and equipment used by employees be in a safe condition, and that modified or mutilated hand tools are not permitted, including makeshift arrangements that overload a wrench by using a pipe extension (cheater bar) on the handle. Certain job sites are no longer allowed to use cheater pipes, notwithstanding the need for tools to help break loose nuts and bolts.

Consequently, there remains a need to provide mechanics and workers with devices that assist the removal of screws, bolts, nuts and other fasteners without the risks associated with cheater bars.

SUMMARY OF THE INVENTION

The present invention provides a safety block device that includes a socket drive member on a lower face for attaching a socket or other tooling for applying torque to a screw, bolt, nut or other fastener, and having a pair of drive pockets in an upper face of the block on opposed sides of a drive axis through the drive member. The pair of drive pockets are sized and arranged to accept a driver of a separately-provided wrench or breaker bar, to permit applying opposed, co-directional torque upon the socket or other tooling.

The present invention also provides a safety block device for applying opposed, co-directional torque upon a socket or other tooling, the safety block device including an elongated body having an upper face, a lower face, and a center portion, a drive post on the lower face of the center portion of the body, configured for attachment thereto of a socket or other tooling for engaging a screw, bolt, nut or other fastener for applying torque thereto, the elongated body having a first pair of drive pockets in an upper face on opposed lateral ends of the elongated body.

The device of the present invention provides a means for applying opposed, co-directional force onto opposed handles extending from the opposed lateral ends of the device. The extending handles increase the amount of torque applied by the user when force is applied at the distal end of the handles. The opposed handles can be, for example, a breaker bar or a socket wrench having a socket drive at one end, which socket drive is of the complementary size to fit securely into the respective drive pockets of the device.

The use of the device for breaking loose screws, bolts and nuts lessens the chance that the socket tool will slip off the end of the screw, bolt or nut, and gives the operator(s) better and greater control of the torque and forces around the drive axis, as well as the capability of providing a greater amount of torque than can be achieved with a single-handled drive wrench.

The drive member of the safety block device can be a removable element, which is releasably positionable within a drive cavity formed in the lower face of the block along the drive axis. The removable element and the drive cavity include a complementary means for releasable retaining the drive member within the drive cavity during use, while allowing easy removal therefrom. This feature permits the user to remove a first-sized socket drive and replace it with a differently-sized socket drive, or to replace it with the same sized socket drive for warranty purposes (i.e., the first-sized socket drive is damaged and rendered unsatisfactory for use).

The drive member is typically the size and shape of a standard socket drive, typically square in footprint, and having standard drive sizes including, but not limited to, ¼ inch, ⅜ inch, ½ inch, ¾ inch, 1 inch, 1½ inch, and others. The drive member accommodates the attachment of the device to standard sockets and other tooling of complementary size. Socket extenders, wobble sockets, and ratcheting adapters can also be used, attached to the drive member. The drive member can include a means for quickly releasing the socket from the drive end of the drive member, by well known means.

The safety block device can be made of steel or any other machine metal, as well as advanced polymer and composite materials.

The use of the safety block device obviates the use of cheater pipes in order apply increased torque upon the socket drive.

Another advantage of the device is that the extending handles can be easily removed from the drive pockets of the drive, to allow easy rotational manipulation of the socket drive block for threading out the screw, bolt or nut once its bite has been broken loose.

The device of the invention is small and compact, and easy carried in a toolbar or tool box.

BRIEF DESCRIPTION OF THE FIGURES

These and further features of the present invention will be apparent with reference to the following description and drawings wherein.

Figure 1:
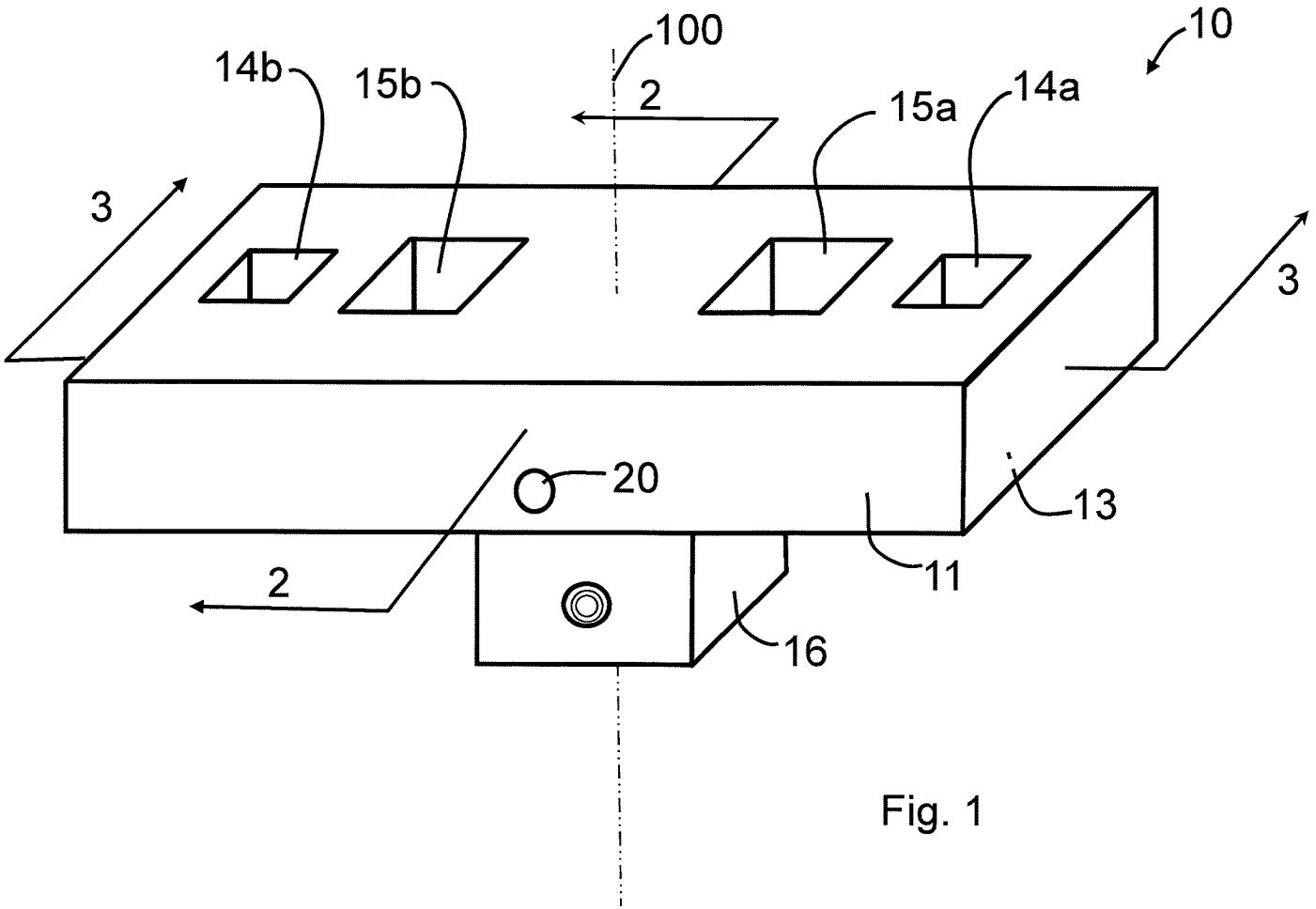
FIG. 1 shows a perspective view of a safety block device of the present invention.
Figure 2:
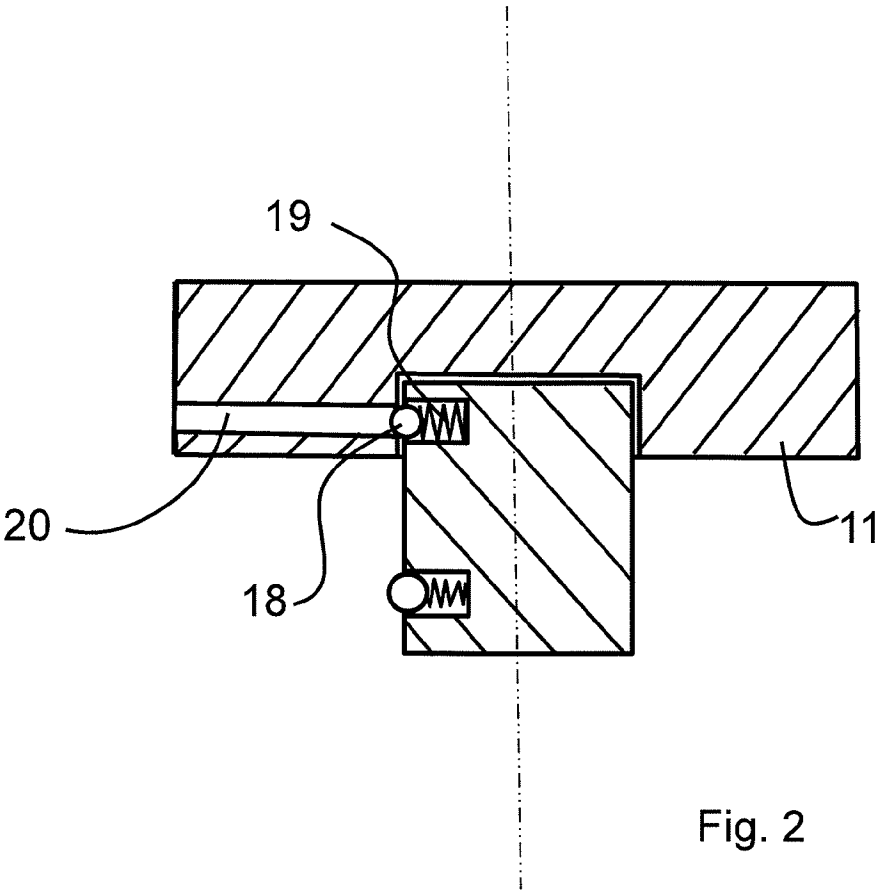
FIG. 2 shows an elevation cross-section view along the width of the safety block through line 2-2 of FIG. 1.

The appended drawings are not necessarily to scale, and are illustrative of the basic principles of the invention. The specific design features of apparatus as disclosed herein, including, for example, specific dimensions, orientations locations, and shapes of the various components, will be determined in part by the particular intended application and use environment. Certain features of the illustrated embodiments have been enlarged or distorted relative to others to facilitate visualization and clear understanding. In particular, thin features may be thickened for clarity or illustration.

DETAILED DESCRIPTION OF THE INVENTION

FIGS. 1-5 show a first embodiment of the safety block of the invention. The safety block 10 includes a rectangular body 11 with an upper face 12 and a lower face 13, and at least one pair of drive pockets, disposed in the upper face 12 on opposite ends of the body 11 at substantially the same distance from a centerline axis 100 normal to the lower face 13. A first pair of drive pockets 14*a*, 14*b* are formed into the body through the upper face 12 at the opposite length ends of the block, each in the shape of a square aperture extending down into the body 11. For illustration purposes, the drive pockets 14*a* and 14*b* accommodate a ½ inch socket drive. The drive pockets 14*a*,14*b* are shown in the center at the far ends, whereby a line passing through the center of each drive pocket 14*a*,14*b* passes through centerline 100, so that the mass and forces that will be applied upon the block at the drive pockets are symmetrical about the centerline axis 100.

In the illustrated embodiment, a second pair of drive pockets 15*a*,15*b* disposed in the upper face 12 on opposite ends of the body 11 at substantially the same distance from the centerline axis 100. For illustration purposes, the drive pockets 15*a* and 15*b* accommodate a ¾ inch socket drive.

Figure 3:
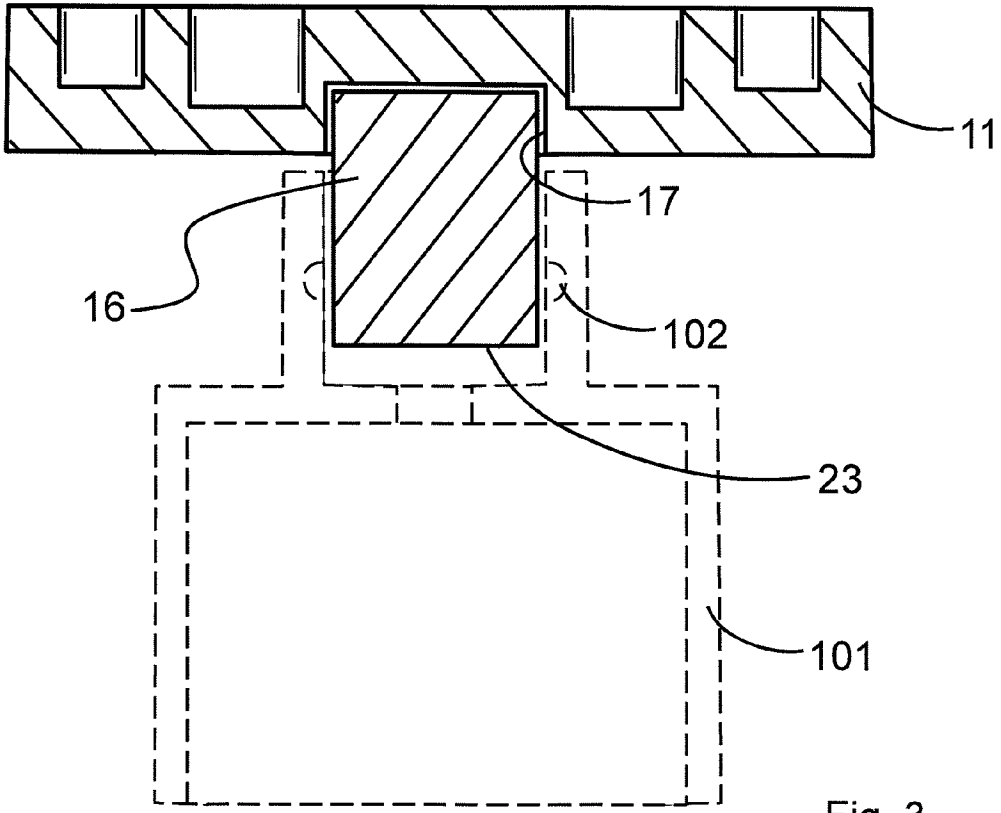
FIG. 3 shows an elevation cross-section view along the length of the safety block through line 3-3 of FIG. 1.
Figure 4:
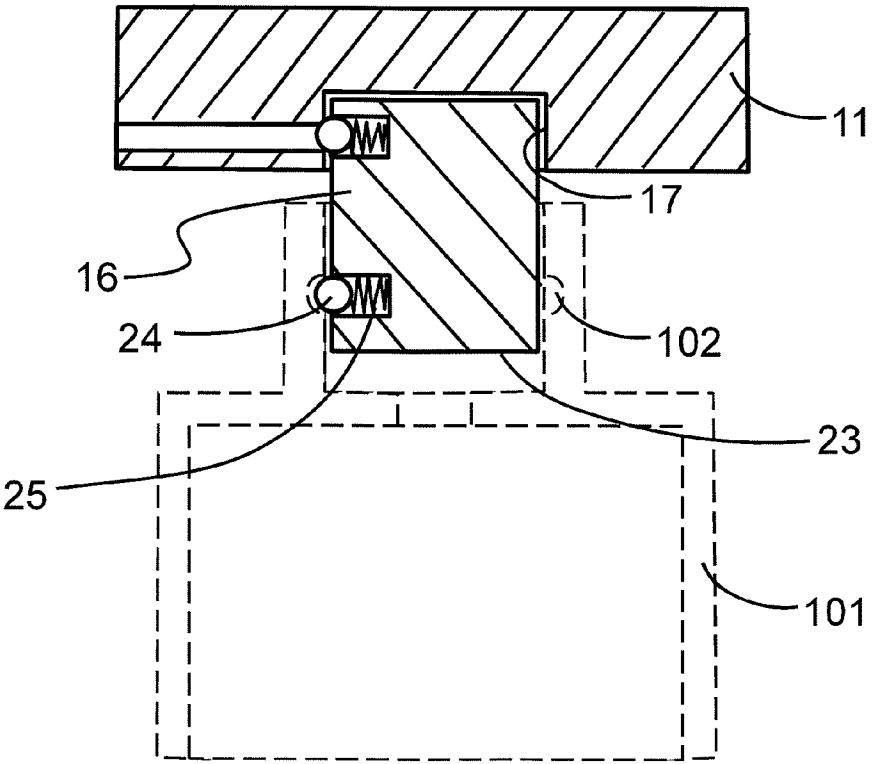
FIG. 4 shows the elevation cross-section view of the safety block of FIG. 2 with a socket tool attached to a socket drive of the safety block, showing a means for quick-release of the socket tool from the socket drive, and a means for release of the socket drive from the safety block.

The safety block 10 also includes a drive member 16 positioned on the lower face 13 of the block. The drive member 16 is typically a rectilinear bar of square lateral cross section, which serves as a socket drive for a separately-provided socket 101, as shown in FIGS. 3 and 4. The drive member is typically the size and shape of a standard socket drive, and can come in standard drive sizes including, but not limited to, ¼ inch, ⅜ inch, ½ inch, ¾ inch, 1 inch, 1½ inch, and others. The drive member accommodates the attachment of the device to a standard socket 101 or other tooling of complementary size. Socket extenders, wobble sockets, and ratcheting adapters (not shown) can also be used, attached to the drive member 16.

In the illustrated embodiment, shown in FIGS. 2-5, the drive member 16 is removable from a drive cavity 17 formed into the lower face 13 of the body 11, centered on the drive axis 100. Typically, the drive cavity 17 is formed to a shape and dimension to accommodate the drive member 16 in a sliding engagement. The removable drive element 16 and the drive cavity 17 include a complementary means for releasable retaining the drive member 16 within the drive cavity 17 during use, while allowing its easy removal therefrom. In the illustrated embodiment shown in FIG. 2, the drive member 16 includes a quick-release means shown as a spring-biased ball 18 retained in a spring hole 19 at one end of the drive member. The body 11 is configured with an aperture 20 formed into the sidewall of the block 11 which communicates with the ball 18 when the drive member 16 is positioned within the drive cavity 17, where it is retained by the ball 18 that is biased outward by the spring so that a portion of the ball 18 extends into the aperture 20 of the block 11. Axial force applied to the drive member 16 pinches the ball 18 down into the spring hole 19, allowing the drive member 18 to be removed. This feature permits the user to remove a first-sized socket drive, such as the 1½ drive as shown, and replace it with a differently-sized socket drive, such as a 1 inch drive, or to replace it with the same sized socket drive for warranty purposes (i.e., the first-sized socket drive is damaged and rendered unsatisfactory for use).

Figure 5:
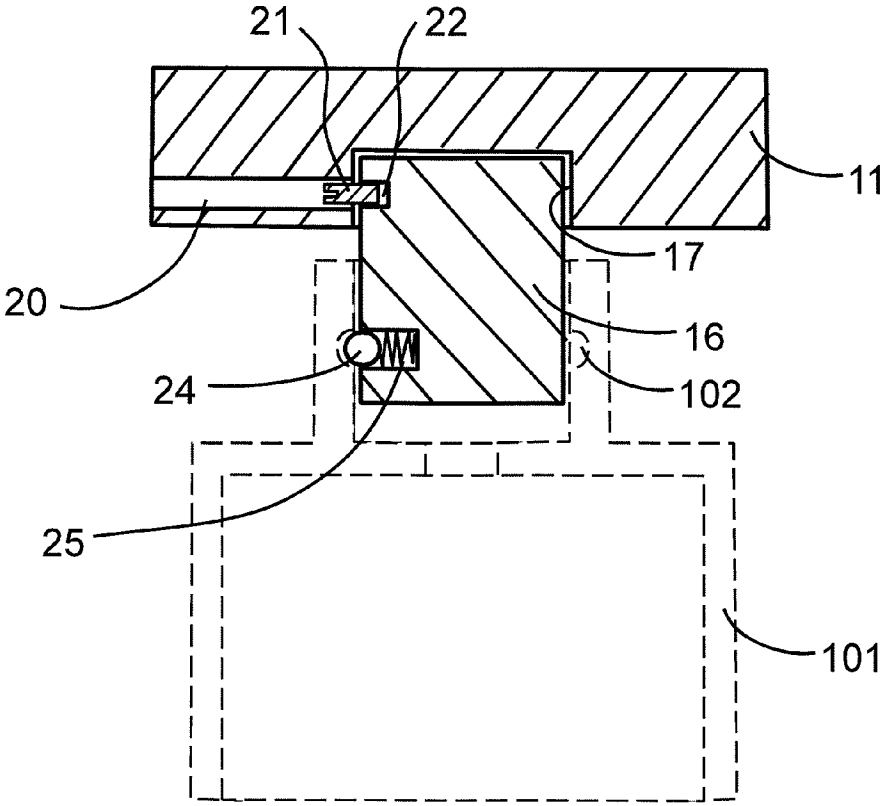
FIG. 5 shows an alternative embodiment of the safety block of FIG. 4, having an alternative means of release of the socket drive from the safety block.

FIG. 5 shows an alternative means for releasable retaining the drive member, consisting of a set screw 21 that can be inserted in through the aperture 20 to thread into tapped hole 22 in the drive member 16.

In another embodiment, the drive member can be retained permanently by inserting a pin in through the aperture of the block and driving the pin into a friction-fitting bore in the side of the drive member.

FIGS. 3 and 4 show the drive end 24 extending down from the body 11. The drive member 16 includes a means for quickly releasing the socket from the drive end of the drive member, preferably a quick-release means, shown as a spring-biased ball 24 disposed in a spring hole 25, which engage an annular recess 102 in the inside of the drive end of standard socket 101.

Figure 6:
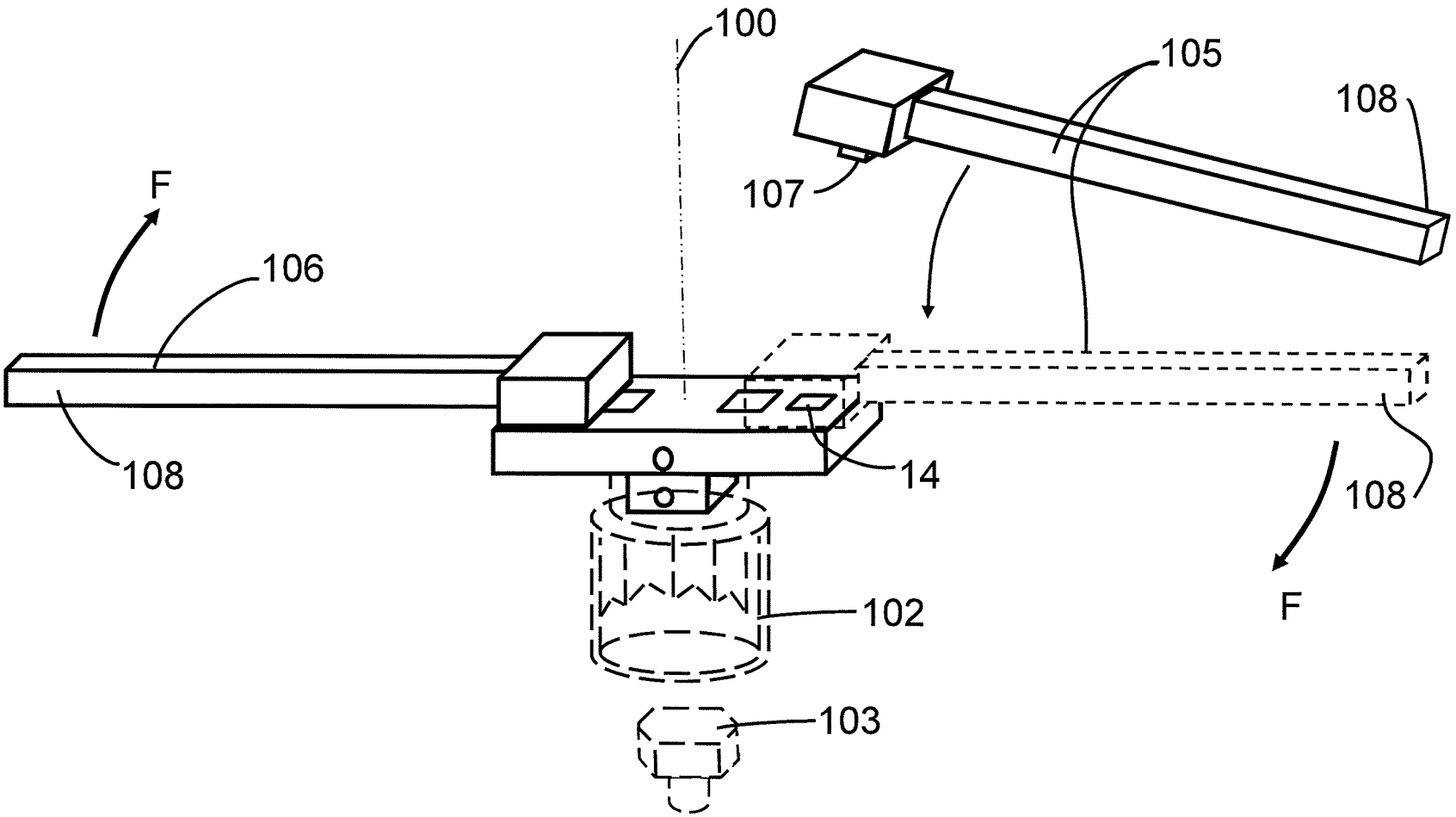
FIG. 6 shows the use of a safety block of the present invention with two separately-provided breaker bars for applying opposed co-directional torque to a socket tool.

FIG. 6 shows the use of the safety block 10 in the field or on machinery for torquing a nut or bolt 103. The socket 102 attached to the underside of the block 11 is positioned over the bolt. A first and second breaker bar 105,106 are positioned with their respective drive 107 inserted into respective drive pockets 14. Once positioned, force F can be applied directionally to each handle end 108 to apply torque to the bolt.

Figure 7:
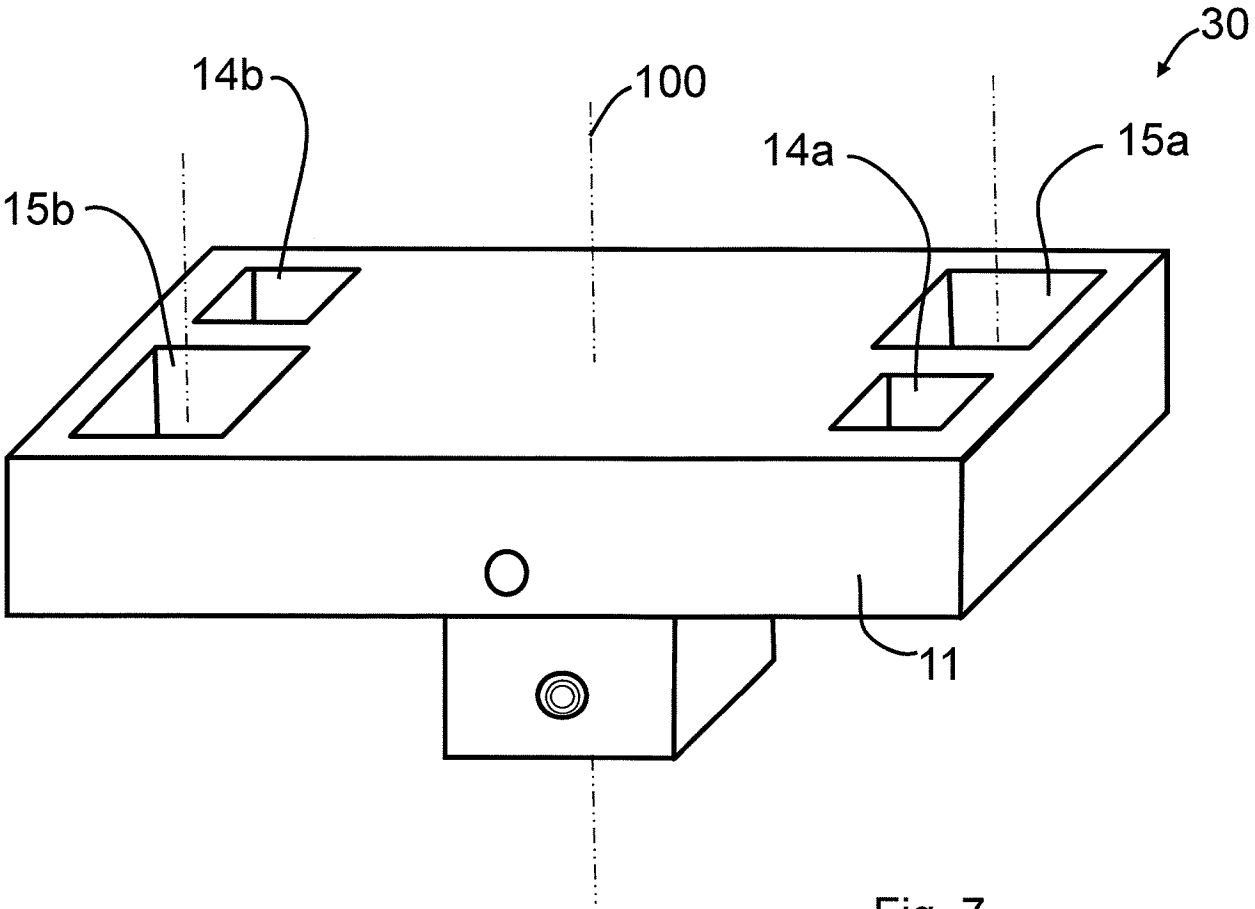
FIG. 7 shows a perspective view of an alternative embodiment of a safety block of the present invention.
Figure 8:
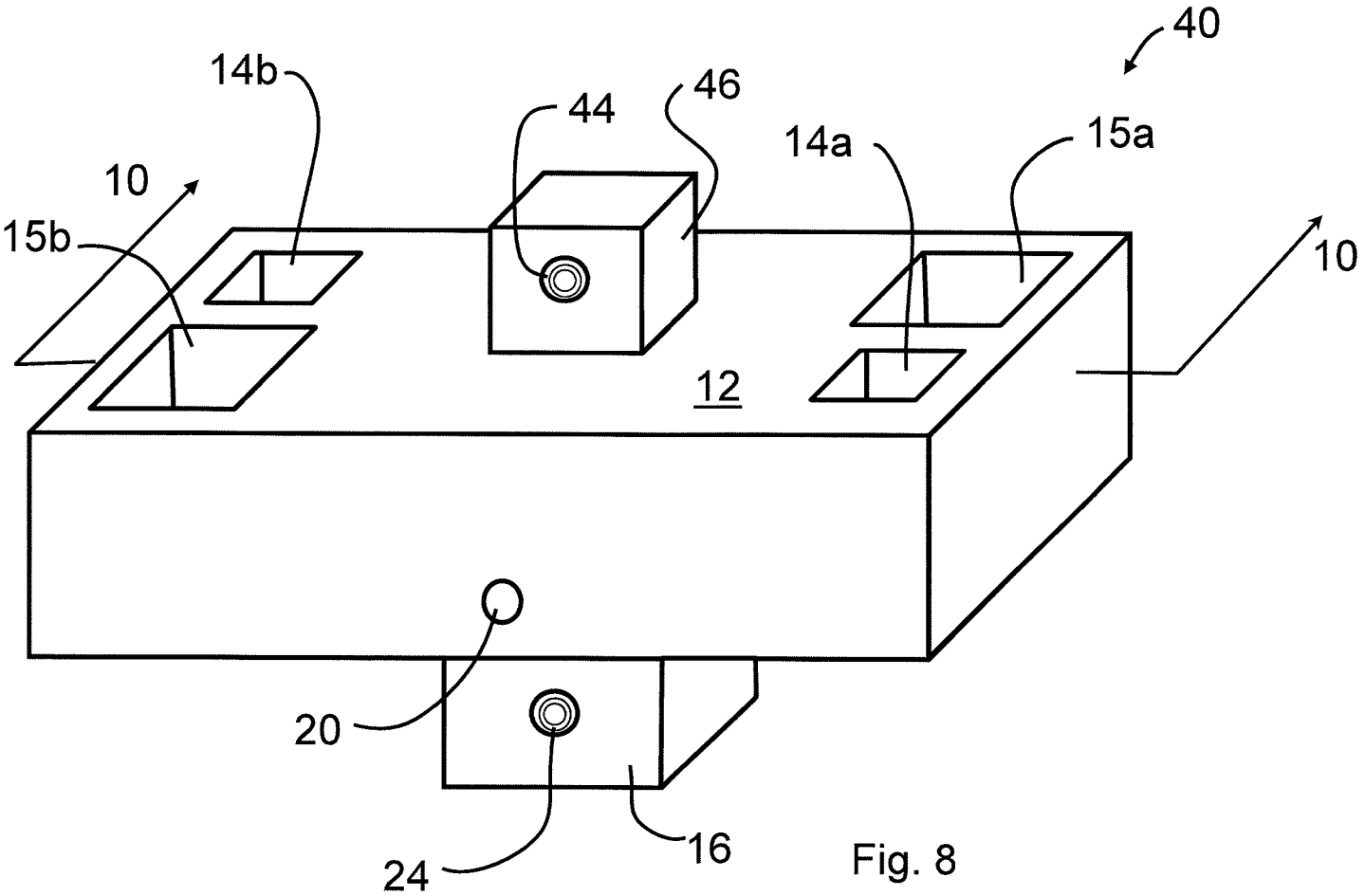
FIG. 8 shows a top perspective view of another alternative embodiment of a safety block of the present invention.
Figure 9:
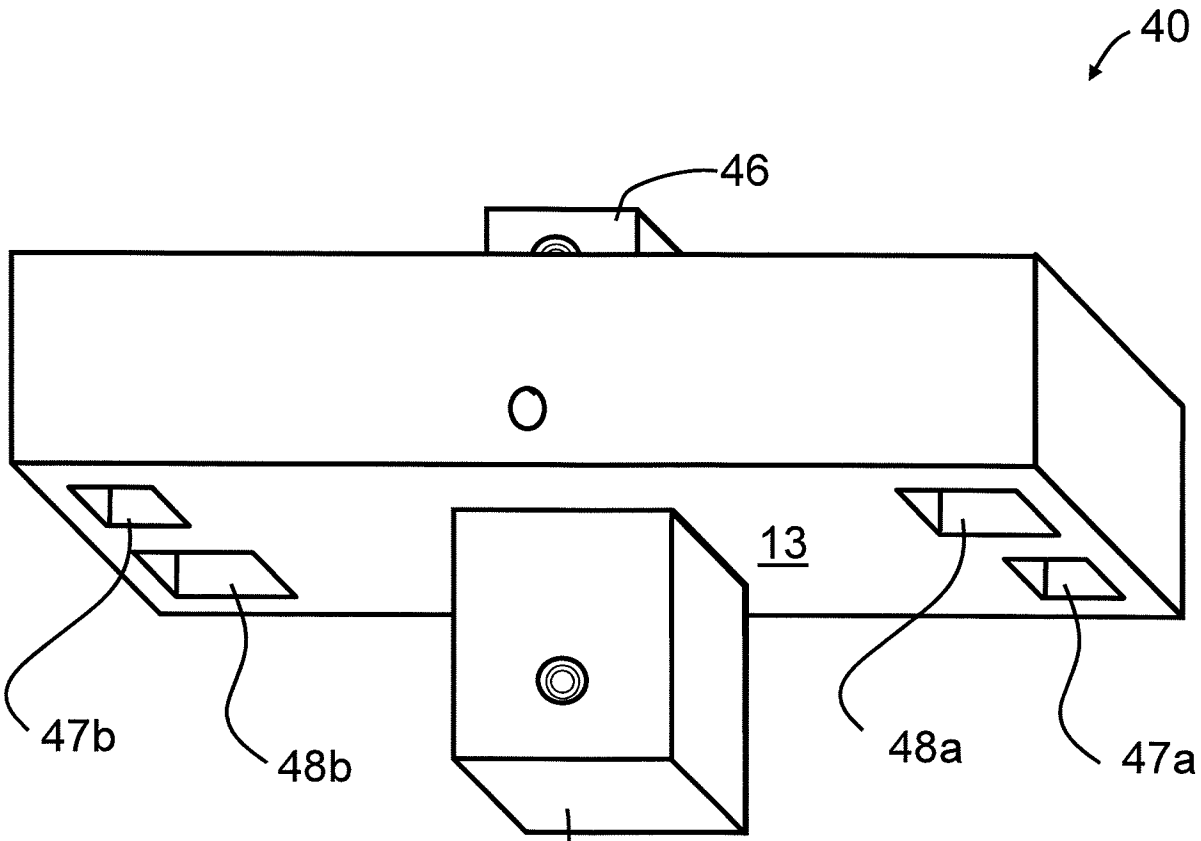
FIG. 9 shows a bottom perspective view of the safety block of FIG. 8.

FIG. 7 shows a second embodiment of the safety block 30, similar to the block 10, where the opposed pairs of the drive sockets 14*a*,14*b* and 15*a*,15*b* are positioned side-by-side at the opposed lateral ends of the elongated body 11. As in the prior embodiment, a line passing through the center of each drive pockets 14*a*,14*b*, or drive pockets 15*a*,15*b*, passes through centerline 100.

Figure 10:
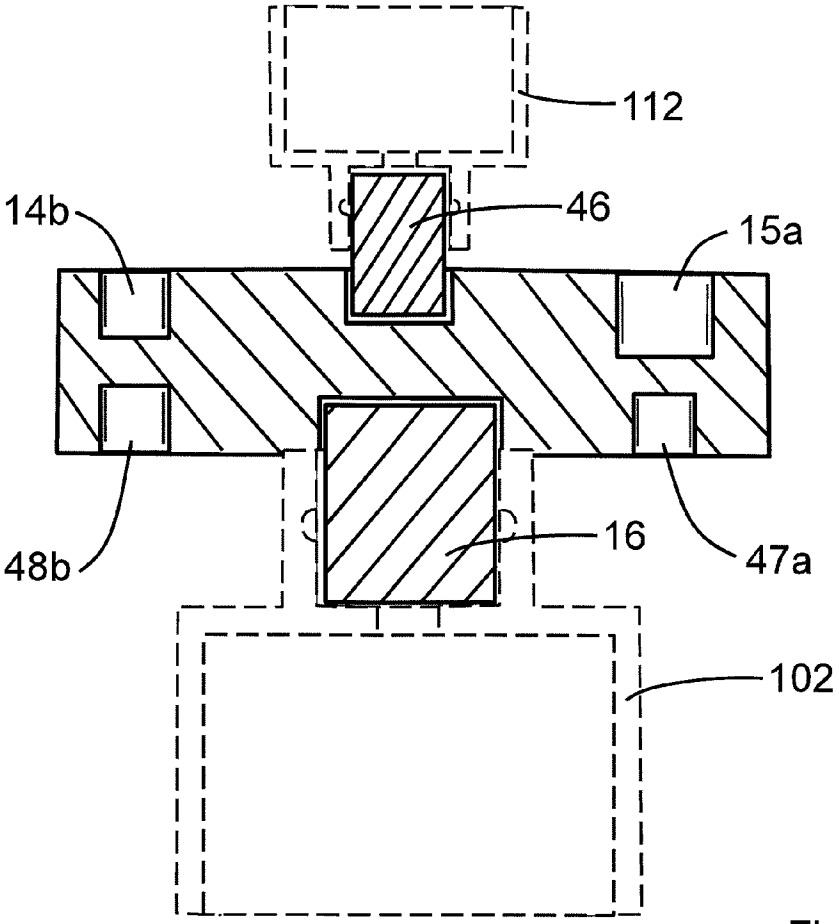
FIG. 10 shows an elevation cross-section view along the length of the safety block through line 10-10 of FIG. 8.
Figure 11:
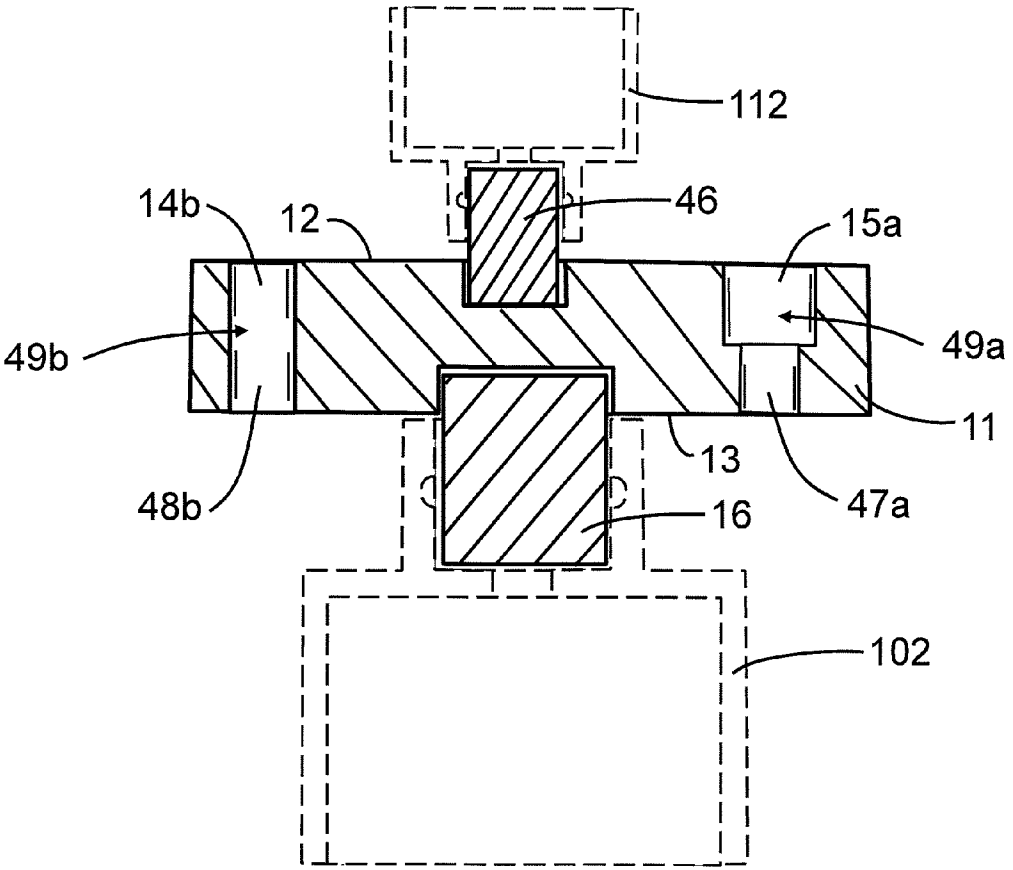
FIG. 11 shows an alternative embodiment of the safety block shown in FIG. 10.

FIGS. 8-11 show a third embodiment of safety block 40. A second drive member 46 is disposed on the upper face 12, opposite the first drive member 16 disposed on the lower face 13. In addition, two additional pairs of drive sockets 47*a*,47*b* and 48*a*,48*b* are disposed in the lower face 13 on opposite ends of the body 11 at substantially the same distance from the centerline axis 100. The additional drive pockets 47*a*,47*b* and 48*a*,48*b* can be sized and dimensioned to accommodate separate-provided breaker bar drive s of various size, as described above. As shown in FIG. 10, each of the drive pockets can be formed into the body 11 to provide a bottomed hole. Alternatively, as shown in FIG. 11, the respective drive pockets on both the upper face 12 and lower face 13 can be formed to intersect, providing through-holes 49*a*,49*b* that pass all the way through the thickness of the body 11.

Figure 12:
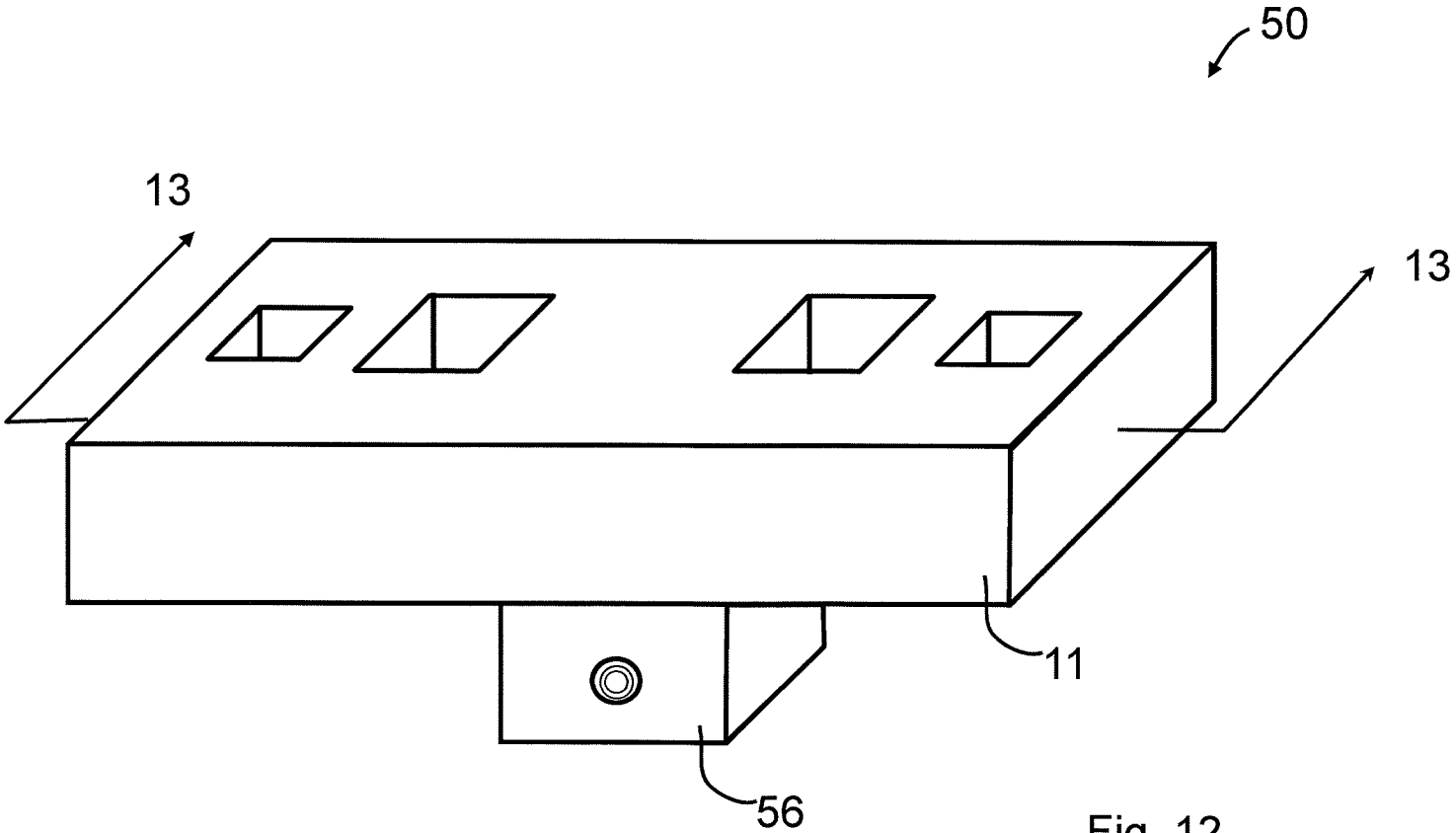
FIG. 12 shows a top perspective view of yet another alternative embodiment of a safety block of the present invention.
Figure 13:
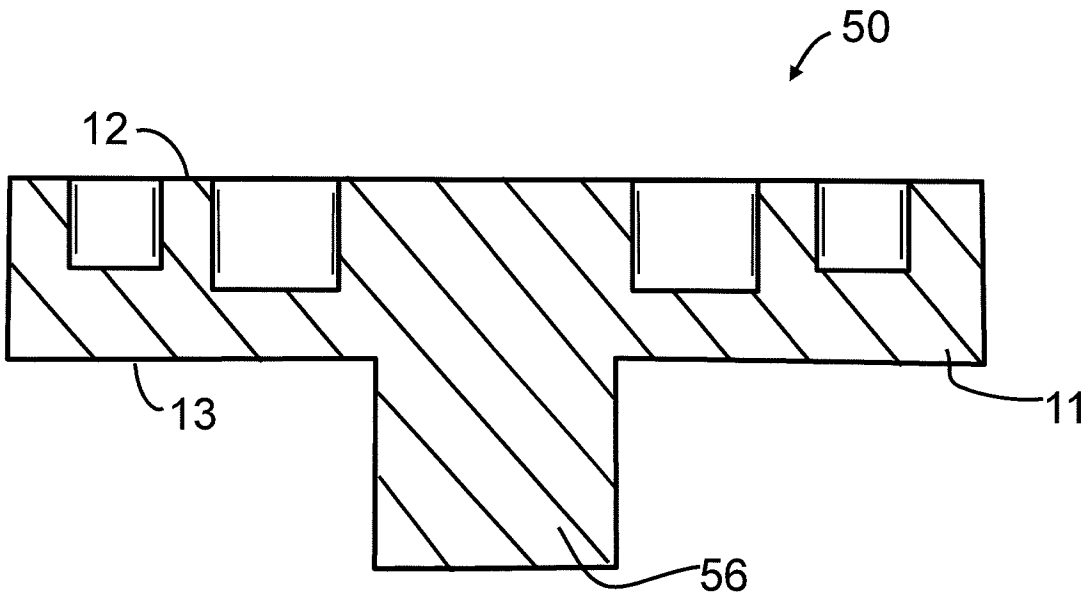
FIG. 13 shows an elevation cross-section view along the length of the safety block through line 13-13 of FIG. 12.

FIGS. 12-13 shows a fourth embodiment of safety block 50, similar to first embodiment safety block 10, but where the drive member 56 extends from and is integral with the body 11.

Figure 14:
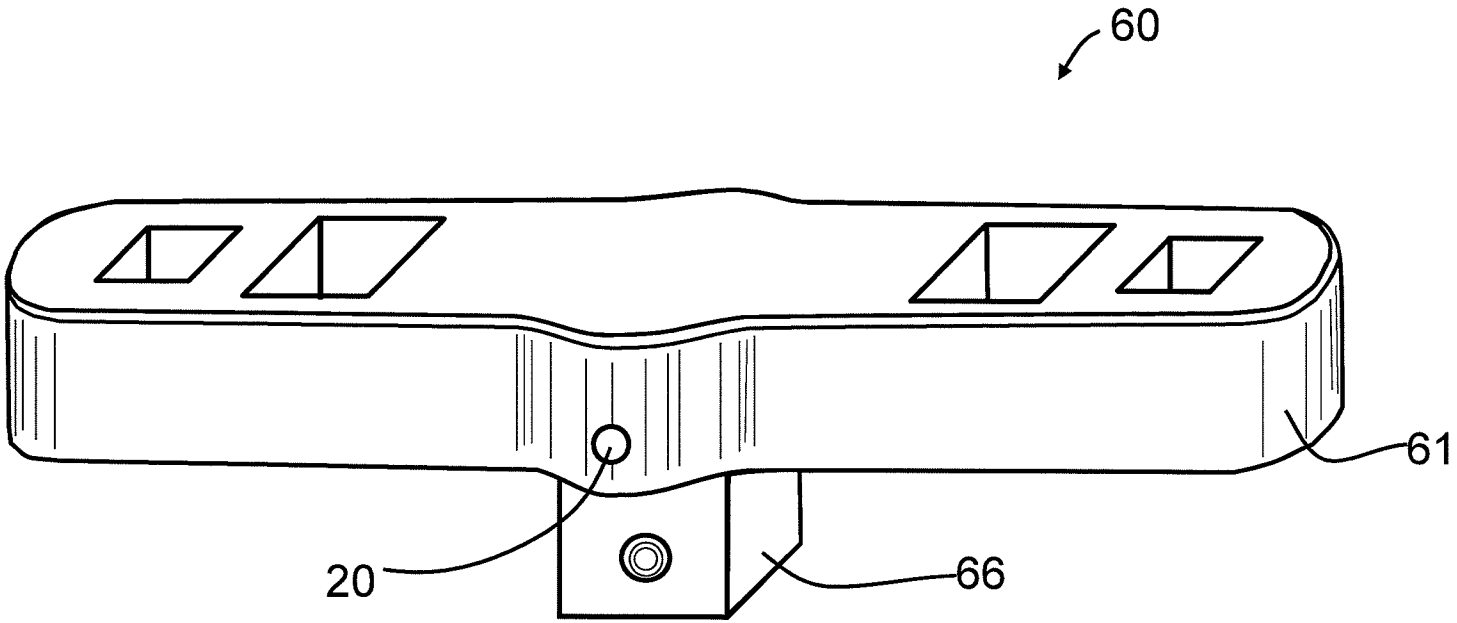
FIG. 14 shows a top perspective view of still another alternative embodiment of a safety block of the present invention.
Figure 15:
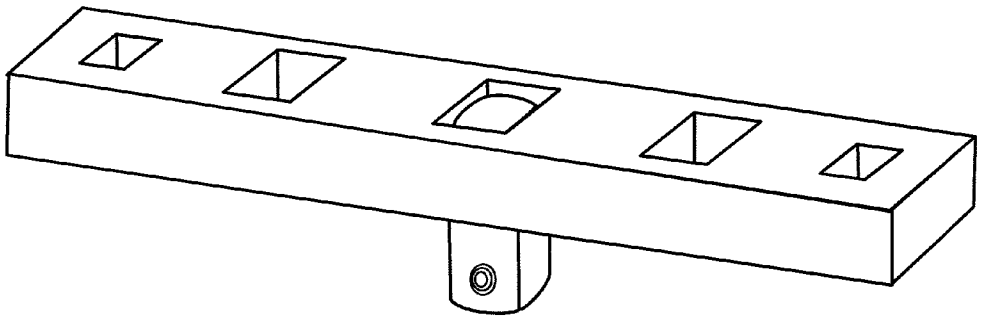
FIG. 15 shows a top perspective view of an alternative embodiment of a safety block of the present invention.
Figure 16:
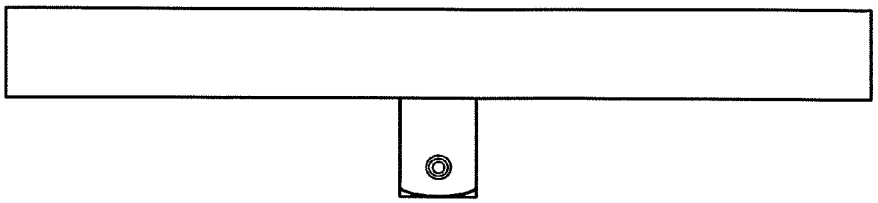
FIG. 16 shows a front view of the safety block of FIG. 15.
Figure 17:
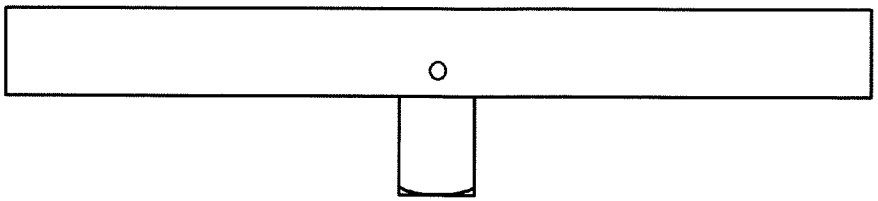
FIG. 17 shows a back view of the safety block of FIG. 15.
Figure 18:
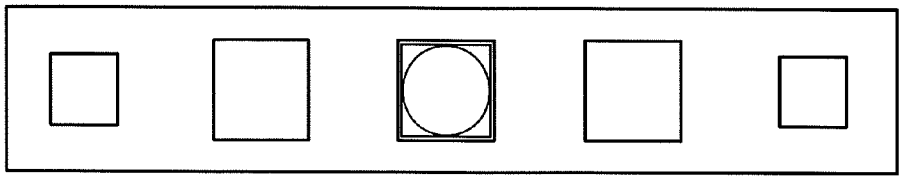
FIG. 18 shows a top view of the safety block of FIG. 15.
Figure 19:
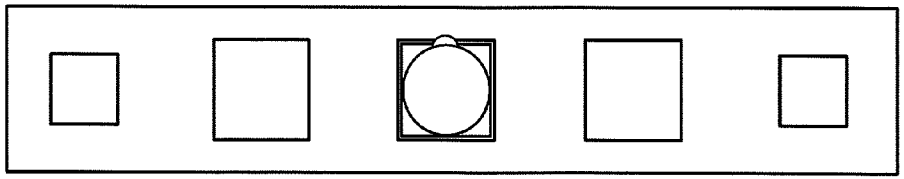
FIG. 19 shows a bottom view of the safety block of FIG. 15.
Figure 20:
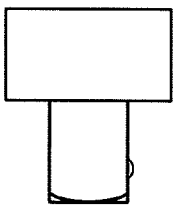
FIG. 20 shows a right side view of the safety block of FIG. 15.
Figure 21:
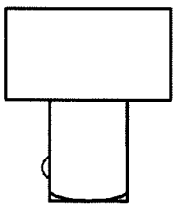
FIG. 21 shows a left side view of the safety block of FIG. 15

FIG. 14 shows a fifth embodiment of safety block 60, similar to first embodiment safety block 10, including drive member 66, where the body 61 has an ergonomic shape for manual handling.

FIGS. 15-21 show various ornamental views of an embodiment of a safety block of the invention.

The safety block can fabricated of steel or any other machine metal, as well as advanced polymer and composite materials. A plastic, ceramic, composite coating can be applied over the outside surfaces of the block.

The present invention also includes methods and means for using the safety block to loosen bolts and other fasteners, by increasing the leverage or torque applied to the fastener, and by applying the torque through opposed, co-directional forces on opposite sides of the safety block, using a separate wrench or breaker bar.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A safety block for applying opposed, co-directional torque upon a socket or other tooling, including a drive member on a lower face for attaching a socket or other tooling for engaging a screw, bolt, nut or other fastener for applying torque thereto, and having a pair of first drive pockets in an upper face of the block on opposed lateral sides of a drive axis through the drive, wherein the pair of drive pockets are each sized and arranged to accept a driver of a separately-provided wrench or breaker bar.

2. The safety block of claim 1 wherein the first pair of drive pockets extend through the lower face of the block.

3. The safety block of claim 1 wherein the first pair of drive pockets have the same square size.

4. The safety block of claim 1 wherein the first pair of drive pockets have the same square size.

5. The safety block of claim 1 further including at least one additional pair of drive pockets in the upper face of a same square size different from the size of first pair of drive pockets.

6. The safety block of claim 5 wherein the drive member is a removable element, which is positioned releasably within a drive cavity in the lower face of the block along the drive axis.

7. The safety block of claim 1 further including at least one additional pair of drive pockets in the upper face of a same square size different from the size of first pair of drive pockets.

8. The safety block of claim 1 wherein the drive member is a removable element, which is releasably positionable within a drive cavity in the lower face of the block along the drive axis.

9. The safety block of claim 1 wherein the block is an elongated rectangle.

10. The safety block of claim 9 wherein the drive axis is through the center of the safety block.

11. The safety block of claim 9 wherein the drive axis is through the center of the safety block.

12. A method for breaking loose nuts and bolts with a safety block, comprising the steps of:

a) providing a safety clock according to claim 1;

b) attaching a socket or other tooling for applying torque to the drive member;

c) inserting a first and second wrench or breaker bar into the pair of first drive pockets, the first and second wrench or breaker bar having extending handles; and d) applying opposed, co-directional force onto an end of each extending handle, thereby applying opposed, co-directional torque upon the socket or other tooling.

13. A safety block for applying opposed, co-directional torque upon a socket or other tooling, including an elongated body having an upper face, a lower face, and a center portion, a drive post on the lower face of the center portion of the body, configured for attachment thereto of a socket or other tooling for engaging a screw, bolt, nut or other fastener for applying torque thereto, the elongated body having a first pair of drive pockets in an upper face on opposed lateral sides of a drive axis through the drive.

14. The safety block of claim 13 wherein the pair of drive pockets is sized and arranged to accept a driver of a separately-provided wrench or breaker bar.

15. The safety block of claim 13 wherein the first pair of drive pockets extend through the lower face of the bar.

16. The safety block of claim 13 wherein the pair of drive pockets have the same square size.

* * * * *